US005846012A

United States Patent [19]

Kudo

[11] Patent Number: 5,846,012

[45] Date of Patent: Dec. 8, 1998

[54] WRITING TOOL

[75] Inventor: Naoto Kudo, Tokyo, Japan

[73] Assignee: Zebra Co. Ltd., Tokyo, Japan

[21] Appl. No.: 510,904

[22] Filed: Aug. 3, 1995

[30] Foreign Application Priority Data

Mar. 7, 1995 [JP] Japan ..... 7-046912

[51] Int. Cl.[6] ..... B43K 8/04; B43K 8/10

[52] U.S. Cl. ..... 401/206; 401/4; 401/34; 401/260

[58] Field of Search ..... 401/34, 4, 206, 401/260

[56] References Cited

U.S. PATENT DOCUMENTS

| | | | |
|---|---|---|---|
| 2,543,195 | 2/1951 | Petion | 401/206 X |
| 3,003,183 | 10/1961 | Rosenthal | 401/206 |
| 3,589,824 | 6/1971 | Andrews et al. | 401/206 X |
| 4,569,612 | 2/1986 | Schwartzman et al. | 401/206 |
| 4,669,637 | 6/1987 | Fiocco | 401/206 X |
| 4,685,820 | 8/1987 | Kremer et al. . | |
| 4,976,564 | 12/1990 | Fukuoka et al. | 401/206 |

FOREIGN PATENT DOCUMENTS

| | | | |
|---|---|---|---|
| 0257931 | 3/1988 | European Pat. Off. . | |
| 2567813 | 1/1986 | France | 401/206 |
| 2604640 | 4/1988 | France . | |
| 61-61074 | 4/1986 | Japan | 401/260 |
| 62-28453 | 7/1987 | Japan . | |
| 532235 | 8/1993 | Japan | 401/260 |
| 6127187 | 5/1994 | Japan | 401/206 |
| 2226755 | 7/1990 | United Kingdom . | |
| WO 91/18750 | 12/1991 | WIPO . | |

*Primary Examiner*—Steven A. Bratlie
*Attorney, Agent, or Firm*—Klauber & Jackson

[57] ABSTRACT

A writing tool including: a cylindrical shell containing ink of a solid-liquid separation type and a stirring piece; an ink flow-out control mechanism disposed in the cylindrical shell, which includes a valve main body having an ink introducing port around the peripheral surface thereof, and a valve which is contained in the valve main body in such a manner as to freely advance and retreat and which is biased in the valve closing direction by a coil spring; and a writing tool mounted to the cylindrical shell through the ink flow-out control mechanism; wherein an enclosed ink containing cylindrical body having a suitable length and diameter is disposed in the cylindrical shell; the ink and the stirring piece are contained in the ink containing cylindrical body; and an ink flow-out port for supplying the ink from the ink containing cylindrical body into an ink introducing port of the valve main body is formed at a suitable portion of the ink containing cylindrical body.

2 Claims, 11 Drawing Sheets

WRITING TOOL

BACKGROUND OF THE INVENTION

1. Field of the Invention

The present invention relates to a writing tool having a writing tip mounted to a cylindrical shell through an ink flow-out control mechanism, wherein the cylindrical shell contains ink of a solid-liquid separation type and a stirring piece.

2. Description of the Related Art

In general, when ink of a solid-liquid separation type is left for a long period of time, a solid component of the ink is deposited and aggregated, to form a cake. A marking pen such as a signing pen using the ink of this type is so constructed that a stirring piece is provided in a cylindrical shell containing the ink. By strongly shaking the cylindrical shell when the writing tool is used, the stirring piece is moved in the longitudinal direction of the cylindrical shell, thereby crushing a cake by an impact force of the stirring piece and dispersing the solid component again.

A prior art writing tool using ink of this type is disclosed, for example, in Examined Japanese Utility Model Publication No. SHO 62-28453. In this writing tool, as shown in FIG. 12, a cylindrical shell 32 contains ink 30 of a solid-liquid separation type and a stirring piece 31 for stirring the ink 30. A writing tip 39 is mounted to a leading end of the cylindrical shell 32 through an ink flow-out control mechanism. The ink flow-out control mechanisms includes a valve main body 34 having an ink introducing port 33 provided on the peripheral surface, a bar-like valve 36 supported in the valve main body 34 in such a manner as to freely advance and retreat, and a coil spring 38 biasing the valve 36 toward a valve seat 37 of the valve main body 34 (in the valve closing direction).

As described above, when ink of a solid-liquid separation type is left as it is for a long period of time, a solid component of the ink is deposited and aggregated, to form a cake. The writing tool using the ink of this type, therefore, is labeled such that in the case where the writing tool is left for a long period of time, it should be laid down or placed with the writing tip 39 side of the cylindrical shell 32 directed upward. Namely, the handling precaution is provided for preventing a solid component from entering the valve main body 34 of the ink flow-out control mechanism and causing a failure in operation of the valve 36.

In practice, however, a user rarely reads such a handling precaution, and most cases, he places the writing tool with the writing tip 39 side directed downward as shown in the figure. For example, the writing tool is placed in a pen stand with the writing tip directed downward just as a ball pen. Consequently, the ink 30 is separated into a solid component and a liquid component with time, and the solid component enters the valve main body 38 including the valve 36 of the ink flow-out control mechanism and the spring 38 biasing the valve 36 toward the valve seat 37, and finally a cake 40 is formed in the valve main body 34. Before the cake 40 is not hardened, it can be crushed by an impact force of the stirring piece 31 against the valve main body 34 which is generated when the cylindrical shell 32 is strongly shaken, and thereby the solid component can be dispersed again. In the case where the cake 40 is hardened, however, it is difficult to be crushed by an impact force of the stirring piece 31. The cake 40 thus perfectly locks the movement of the valve 36, to thereby obstruct the supply of the ink 30 to the writing tip 39.

SUMMARY OF THE INVENTION

Accordingly, an object of the present invention is to provide a writing tool using ink of a solid-liquid separation type, which is capable of preventing a solid component of ink from being deposited on an ink flow-out control mechanism side and from entering in a valve main body of the ink flow-out control mechanism even when the writing tool is placed with a writing tip side directed downward.

Another object of the present invention is to provide a writing tool using ink of a solid-liquid separation type, which is capable of effectively crushing a cake of ink and stirring the ink.

A further object of the present invention is to provide a writing tool of a solid-liquid separation type, which is capable of mounting two kinds of writing tools having different diameters on both the ends of a cylindrical shell.

To achieve the above object, according to a first aspect of the present invention, there is provided a writing tool comprising:

a cylindrical shell containing ink of a solid-liquid separation type and a stirring piece;

an ink flow-out control mechanism disposed in the cylindrical shell, which includes a valve main body having an ink introducing port around the peripheral surface thereof, and a valve which is contained in the valve main body in such a manner as to freely advance and retreat and which is biased in the valve closing direction by a coil spring; and a writing tool mounted to the cylindrical shell through the ink flow-out control mechanism;

wherein an enclosed ink containing cylindrical body having a suitable length and diameter is disposed in the cylindrical shell; the ink and the stirring piece are contained in the ink containing cylindrical body; and an ink flow-out port for supplying the ink from the ink containing cylindrical body into an ink introducing port of the valve main body is formed at a suitable portion of the ink containing cylindrical body.

Ink of a solid-liquid separation type is separated into a solid component and a liquid component with time in the leaving state. However, in the above writing tool of the present invention, since a solid component of ink is deposited and aggregated in the ink containing cylindrical body separated from the ink flow-out control mechanism to form a cake, the solid component of ink is prevented from entering the ink flow-out control mechanism. When the writing tool is used, by strongly shaking the cylindrical shell, the stirring piece contained in the ink containing cylindrical body together with the ink is moved in the longitudinal direction, to crush the cake, thus dispersing the solid component in the liquid component again. The ink is supplied from the ink flow-out port of the ink containing cylindrical body into the valve main body of the ink flow-out control mechanism through the ink introducing port on the outer peripheral surface of the valve main body, to be thus supplied to a writing tip. Moreover, by provision of the ink containing cylindrical body serving as an ink storage tank separately from the ink flow-out control mechanisms, it is possible to mount two kinds of writing tips having different diameters to the writing tool, and hence to improve the versatility of the writing tool and thereby the commercial value thereof.

According to a second aspect of the present invention, the ink containing cylindrical body is contained in the cylindrical shell in such a manner as to be movable in the longitudinal direction of the cylindrical shell.

In this writing tool, the impact generated upon movement of the ink containing cylindrical body in addition to an impact force of the stirring piece is applied to a cake. This accelerates not only the crushing action for the cake, but also the stirring action of uniformly dispersing the solid component in the liquid component. When the writing tool is used, ink can be smoothly supplied to a writing tip only by strongly shaking by one or several times.

According to a third aspect of the present invention, the ink flow-out port is formed on the wall of the ink containing cylindrical body at a portion at least separated from an enclosed end portion of the ink containing cylindrical body by a height more than that of a cake formed by deposition and aggregation of a solid component of the ink; and an ink flowing groove extending in the longitudinal direction of the cylindrical shell is formed on the wall of the ink containing cylindrical body in such a manner as to communicate the ink flow-out port to the ink introducing port of the valve main body.

In this writing tool, the cake is prevented from getting over the ink flow-out port and entering the ink flowing groove communicating the opening end of the ink flow-out port to the ink introducing port of the valve main body. As a result, the ink flowing groove is prevented from being clogged with the cake, and the ink in the ink containing cylindrical body in which the solid component is dispersed again is certainly supplied from the ink flow-out port into the valve main body through the ink flowing groove.

According to a fourth aspect of the present invention, the ink flow-out port having a suitable diameter is formed at least at the axial center of the enclosed end portion of the ink containing cylindrical body; and the stirring piece is formed in such a shape as to seal the ink flow-out port in the leaving state of the writing tool.

When this writing tool is placed with the above ink flow-out port directed downward, the ink flow-out port is instantly sealed by the stirring piece having such a shape as to seal the ink flow-out port. Accordingly, the solid component of ink is prevented from entering the valve main body through the ink flow-out port, and is deposited and aggregated on the end portion side of the ink containing cylindrical body with the ink flow-out port sealed by the stirring piece. When the writing tool is used, by strongly shaking the cylindrical shell, the cake is crushed by an impact force of the stirring piece, and the ink in the ink containing cylindrical body in which the solid component is dispersed again is directly supplied from the ink flow-out port into the valve main body, to be thus supplied to a writing tip.

According to a fifth aspect of the present invention, there is provided a writing tool comprising:

a cylindrical shell containing ink of a solid-liquid separation type and a stirring piece;

an ink flow-out control mechanism disposed in the cylindrical shell, which includes a valve main body having an ink introducing port around the peripheral surface thereof, and a valve which is contained in the valve main body in such a manner as to freely advance and retreat and which is biased in the valve closing direction by a coil spring; and a writing tool mounted to the cylindrical shell through the ink flow-out control mechanism;

wherein an annular sealing projection to be closely contacted with the inner periphery of the cylindrical shell is provided around the outer periphery of the enclosed rear end portion of the valve main body; an ink flow-out port communicated to the valve main body is formed at the axial center of the rear end portion of the valve main body; and the stirring piece is formed in such a shape as to seal the ink flow-out port in the leaving state of the writing tool.

When this writing tool is left as it is, the ink flow-out port is instantly sealed by the stirring piece having such a shape as to seal the ink flow-out port. Accordingly, the solid component of ink is prevented from entering the valve main body through the ink flow-out port, and is deposited and aggregated on the end portion side of the ink containing cylindrical body with the ink flow-out port sealed by the stirring piece. When the writing tool is used, by strongly shaking the cylindrical shell, the cake is crushed by an impact force of the stirring piece, and the ink in the ink containing cylindrical body in which the solid component is dispersed again is directly supplied from the ink flow-out port into the valve main body, to be thus supplied to a writing tip.

According to a sixth aspect of the present invention, there is provided a writing tool comprising:

a cylindrical shell containing ink of a solid-liquid separation type and a stirring piece;

an ink flow-out control mechanism disposed in the cylindrical shell, which includes a valve main body having an ink introducing port around the peripheral surface thereof, and a valve which is contained in the valve main body in such a manner as to freely advance and retreat and which is biased in the valve closing direction by a coil spring; and a writing tool mounted to the cylindrical shell through the ink flow-out control mechanism;

wherein an ink depositing portion is formed in the valve main body in such a manner as to coaxially extend in the longitudinal direction from the enclosed rear end of the valve main body, the ink deposition portion having a height more than that of a cake formed by deposition and aggregation of a solid component of the ink; and an ink flowing groove extending in the longitudinal direction of the cylindrical shell is formed around the outer periphery of the valve main body in such a manner as to communicate the opening end of the ink depositing portion to the ink introducing port of the valve main body.

When this writing tool is left as it is, the solid component is prevented from entering the valve main body, and the ink flowing groove communicating the opening end of the ink depositing portion to the ink introducing port of the valve main body is prevented from being clogged with the cake. When the writing tool is used, by strongly shaking the cylindrical shell, the cake in the ink depositing portion is crushed by an impact force of the stirring piece and the solid component is dispersed again. Thus, the ink is directly supplied into the valve main body through the ink flowing groove, and is further supplied to a writing tip.

DETAILED DESCRIPTION OF THE PREFERRED EMBODIMENTS

Figure 1A:
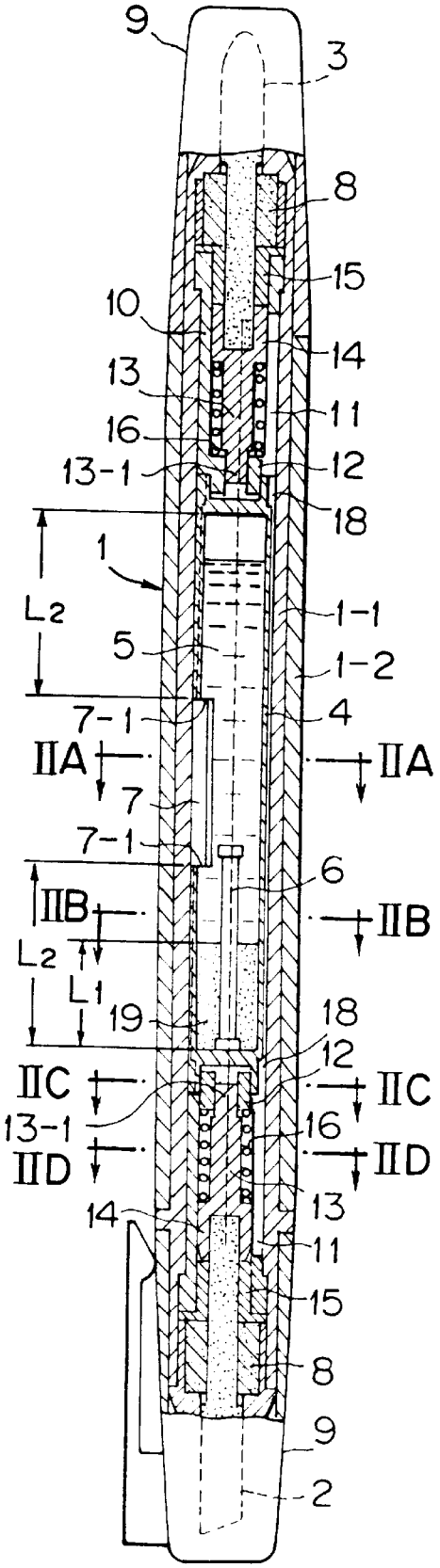
FIG. 1A is a vertical sectional view of a first embodiment of a double writing tip type writing tool of the present invention.
Figure 1B:
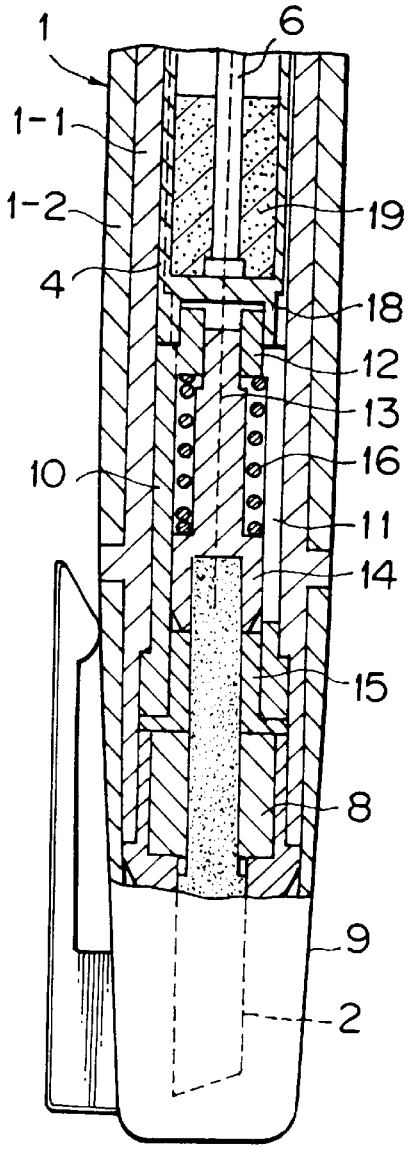
FIG. 1B is an enlarged sectional view of an essential portion of the writing tool shown in FIG. 1A.

Hereinafter, preferred embodiments of the present invention will be described with reference to the drawings.

Embodiment 1

FIGS. 1A to 3 show a first embodiment of a writing tool of a double writing tip type having writing tips 2, 3 mounted to both ends of a cylindrical shaft 1 through ink flow-out control mechanisms, wherein an enclosed ink containing cylindrical body 4 containing ink 5 of a solid-liquid separation type and a bar-like stirring piece 6 is disposed in the cylindrical shaft 1. An ink flow-out port 7 for supplying the ink 5 into valve main bodies 10 of the ink flow-out control mechanisms is formed in the wall of the ink containing cylindrical body 4. The ink 5 in the ink containing cylindrical body 4 is supplied into the valve main bodies 10 through the ink flow-out port 7, to be thus supplied to the writing tips 2, 3. In the figures, reference numeral 8 indicates an ink holding body made of polyurethane or the like, and reference numeral 9 indicates a cap for sealing each of the writing tips 2, 3.

The cylindrical shaft 1 has a double-pipe structure composed of an inner pipe 1-1 opened on both end sides and containing the ink flow-out control mechanisms and the ink containing cylindrical body 4, and an outer pipe 1-2 opened on both end sides and covering the inner pipe 1-1 excluding both the end portions thereof. The ink flow-out control mechanisms are internally provided in both the end portions of the inner pipe 1-1, and the writing tips 2, 3 are mounted to both the end portions of the inner pipe 1-1 through the ink flow-out control mechanisms. The ink containing cylindrical body 4 is disposed between the valve body main bodies 10 which are fixedly provided in the inner-pipe 1-1 on both the end sides.

The ink flow-out control mechanism includes the valve main body 10 having ink introducing ports 11 formed on the peripheral surface, a stepped bar-like valve 13 which is provided coaxially in the valve main body 10 so as to freely advance and retreat therein and which has an inserting portion 13-1 inserted in and supported by a valve supporting portion 12 provided at the rear end of the valve main body 10, a coil spring 16 mounted between a tip holding portion 14 positioned at the leading end of the valve 13 and the valve supporting portion 12 for biasing the valve 13 toward a valve seat 15 fitted at the leading end of the valve main body 10, that is, in the valve closing direction. The valve 13 is opened by pressing either of the writing tips 2, 3 against a paper sheet for retreating the valve 13 against the coil spring 16, thus supplying the ink in the valve main body 10 to the writing tip pressed on the paper sheet.

The ink containing cylindrical body 4 serves as an ink storage tank containing the ink 5 in the state that the ink 5 is separated from the valve main bodies 10. With this construction, a solid component of the ink 5 is prevented from entering the valve main bodies 10. The enclosed ink containing cylindrical body 4 provided between the valve supporting portions 12 of the valve main bodies 10 has an outside diameter being substantially the same as the inside diameter of the inner-pipe 1-1. The ink flow-out port 7 for supplying the ink 5 into the ink introducing ports 11 of each valve main body 10 is formed in the wall of the ink containing cylindrical body 4. Ink flowing grooves 17 extending from an opening end 7-1 of the ink flow-out port 7 to the ink introducing ports 11 of the valve main body 10 are provided on the outer periphery of the ink containing cylindrical body 4. The ink 5 is thus supplied from the ink flow-out port 7 into the valve main body 10 through the ink flowing grooves 17.

Each of the enclosed ends of the ink containing cylindrical body 4 is formed in a recessed shape so as to be fitted around the outer periphery of the valve supporting portion 12 of the valve main body 10. Communicating grooves 18 for communicating the ink flowing grooves 17 to the ink introducing ports 11 of the valve main body 10 are provided on the outer periphery of the recessed portion of the ink containing cylindrical body 4 (see FIG. 2). The ink 5 passing through the ink flowing grooves 17 is smoothly guided from the communicating grooves 18 to the ink introducing ports 11, to be thus supplied in the valve main body 10.

The ink flow-out port 7 is provided to supply the ink 5 in the ink containing cylindrical body 4 into the valve main body 10 through the ink flowing grooves 17. The ink flow-out port 7 is formed in the wall of the ink containing cylindrical body 4 in such a manner that each of the opening ends 7-1 is separated from each end of the ink containing cylindrical body 4 by a height $L_2$ more than a height $L_1$ of a cake 19. This prevents the cake 19 from getting over the opening end 7-1 of the inkflow-out port 7 and from entering the ink flowing grooves 17. As a result, the ink flowing grooves 17 are prevented from being clogged with the cake 19.

Figure 2A:
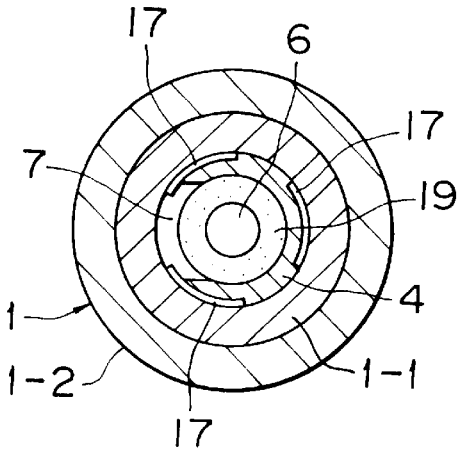
FIG. 2A is an enlarged sectional view taken along line IIA—IIA of FIG. 1A.
Figure 3:
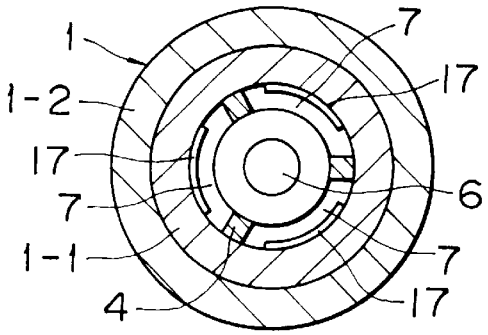
FIG. 3 is a vertical sectional view taken along line IIA—IIA of FIG. 1A showing the case where several ink flow-out ports are provided.

In the example shown in FIG. 2A, one piece of the ink flow-out port 7 is provided in the circumferential direction of the ink containing cylindrical body 4. However, several pieces of the ink flow-out ports 7 may be provided in the circumferential direction of the ink containing cylindrical body 4 as shown in FIG. 3. In this case, they may be provided by the number corresponding to that of the ink flowing grooves 17.

Figure 2B:
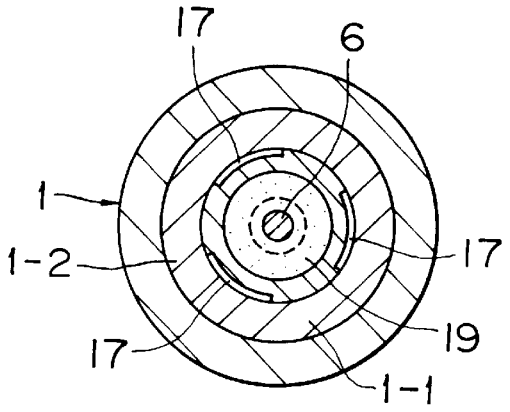
FIG. 2B is an enlarged sectional view taken along line IIB—IIB of FIG. 1A.
Figure 2C:
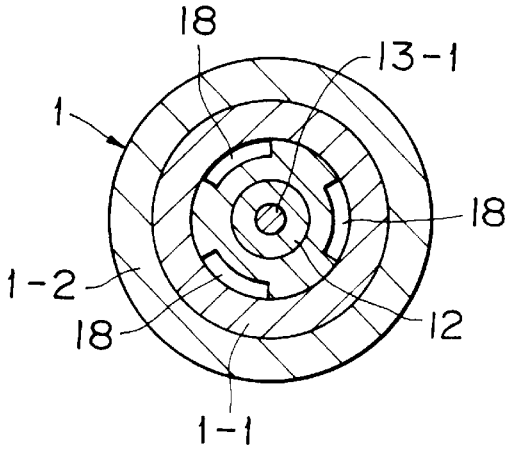
FIG. 2C is an enlarged sectional view taken along line IIC—IIC of FIG. 1A.
Figure 2D:
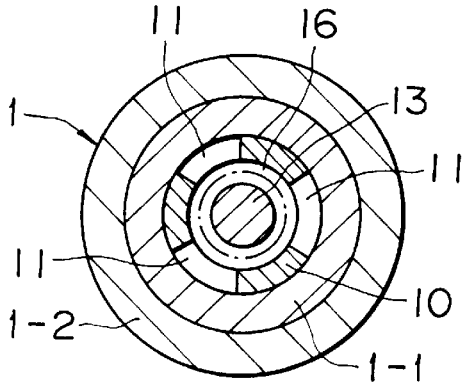
FIG. 2D is an enlarged sectional view taken along line IID—IID of FIG. 1A.

Several pieces of the ink flowing grooves 17 are provided in the circumferential direction of the ink containing cylindrical body 4 so as to extend from the opening ends 7-1 of the ink flow-out port 7 to the communicating grooves 18 of the ink containing cylindrical body 4 (see FIGS. 2A and 2B).

The operation of the writing tool having the above-described construction will be described below.

When either of the writing tips 2, 3 is pressed on a paper sheet, the valve 13 in the valve main body 10 is retreated against the coil spring 16, thus opening the valve seat 15. At this time, the ink 5 is supplied from the ink containing cylindrical body 4 through the ink flow-out port 7, passing through the ink flowing grooves 18 and the communicating grooves 18, and is supplied from the ink introducing ports 11 into the valve main body 10. The ink 5 is thus supplied from the valve main body 10 to the writing tip pressed on the paper sheet. In the case where the writing tool is placed with either of the writing tips 2, 3 directed downward, a solid component of the ink 5 is deposited and aggregated on the closed end side directed downward of the ink containing cylindrical body 4, to form the cake 19. In this case, since the height $L_2$ of each opening end 7-1 of the ink flow-out port 7 from the closed end of the ink containing cylindrical body 4 is larger than the height $L_1$ of the cake 19, the cake 19 is prevented from getting over the opening end 7-1. Therefore, the ink flowing grooves 17 for communicating the opening end 7-1 of the ink flow-out port 7 to the communicating grooves 18 formed around the outer periphery of the end portion of the ink containing cylinder body 4 are prevented from being clogged with the cake 19. When the writing tool is used, by strongly shaking the cylindrical shell 1, the cake 19 is crushed by an impact force of the bar-like stirring piece 6 moved in the longitudinal direction of the ink containing cylindrical body 4, and the solid component is dispersed again in the liquid component in the ink containing cylindrical body 4.

According to the writing tool in this embodiment, even when it is placed with the writing tip 2 directed upward, the solid component of the ink 5 is deposited and aggregated to form the cake 19 in the ink containing cylindrical body 4 separated from the ink flow-out control mechanism, so that it is possible to eliminate a failure in operation of the ink flow-out control mechanism, for example, the locking of the valve 13 due to the solid component permeating in the valve main body 10, and hence to stably and certainly supply the ink 5 to the writing tips 2, 3. Moreover, by provision of the ink containing cylindrical body 4 serving as an ink storage tank separately from the ink flow-out control mechanisms, it is possible to mount two kinds of writing tips having different diameters to the writing tool, and hence to improve the versatility of the writing tool and thereby the commercial value thereof.

Embodiment 2

Figure 4A:
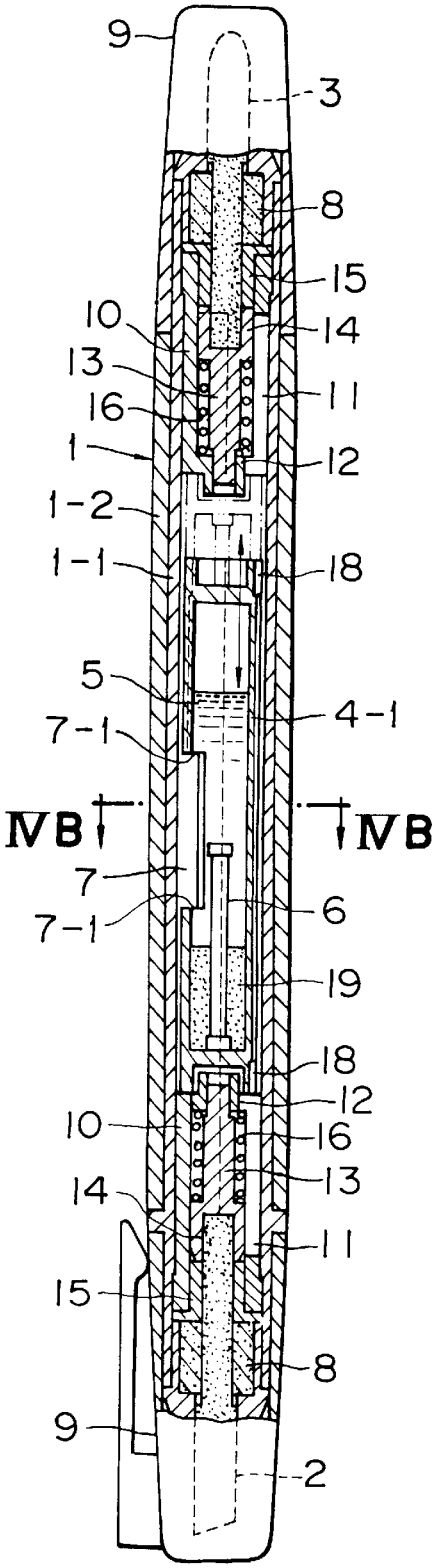
FIG. 4A is a vertical sectional view of a second embodiment of a double writing tip type writing tool of the present invention.
Figure 4B:
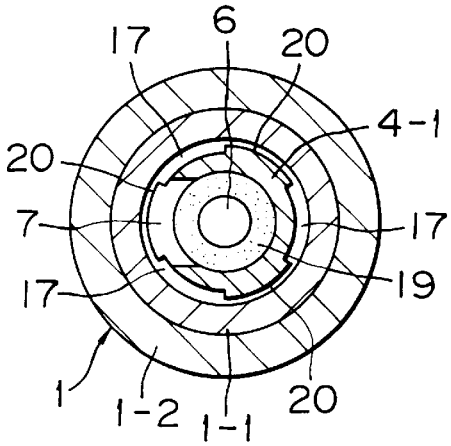
FIG. 4B is an enlarged sectional view taken along line IVB—IVB of FIG. 4A.

FIGS. 4A and 4B show a second embodiment of a double writing tip type writing tool, wherein an ink containing cylindrical body 4-1 is disposed in an inner-pipe 1-1 in such a manner as to be moved in the longitudinal direction by movement of a bar-like stirring piece 6 when a cylindrical shell 1 is strongly shaken. In addition, this embodiment has the same construction as that of the first embodiment, except for the ink containing cylindrical body 4-1, and accordingly, parts corresponding to those in the first embodiment are indicated at the same characters, and the explanation thereof is omitted.

In this embodiment, the ink containing cylindrical body 4-1 is formed such that the length thereof is shorter than an interval between valve supporting portions 12 of valve main bodies 10 fixedly disposed in the inner-pipe 1-1 on both the end sides. Accordingly, when the cylindrical shell 1 is strongly shaken, the ink containing cylindrical body 4-1 is moved along the longitudinal direction in the inner pipe 1-1 so as to collide with the valve main bodies 10 by the longitudinal movement of the stirring piece 6. Each of the recessed portions at both the enclosed ends of the ink containing cylindrical body 4-1 is formed to have an inside diameter larger than the outside diameter of each of the valve supporting portions 12 of the valve main bodies 10 so as to be freely fitted around the outer periphery of the valve supporting portion 12. In addition, vertical ribs 20 extending in the longitudinal direction are provided on the outer periphery of the containing cylindrical body 4-1 between ink flowing grooves 17 for suppressing the contact resistance with the inner peripheral surface of the inner-pipe 1-1, and thereby the ink containing cylindrical body 4-1 can be smoothly moved in the longitudinal direction in the inner pipe 1-1 when the cylindrical shell 1 is strongly shaken (see FIG. 4B).

In the writing tool of this embodiment, when the cylindrical shell 1 is strongly shaken, the ink containing cylindrical body 4-1 is moved in the longitudinal direction by the longitudinal movement of the stirring piece 6, and consequently, the impact (vibration) generated by the movement of the ink containing cylindrical body 4-1 in addition to an impact force of the bar-like stirring piece 6 is applied to a cake 19, to thus accelerate the crushing action for the cake 19. Moreover, the stirring action of dispersing the solid component thus crushed in the liquid component is also accelerated by the above-described impact of the longitudinal movement of the ink containing cylindrical body 4-1. Accordingly, only by strongly shaking the cylindrical shell 1 by one or several times when the writing tool is used, the ink 5 can be smoothly supplied from the ink flow-out port 7 into the valve main bodies 10 through the ink flowing grooves 17, to be supplied to the writing tips 2, 3.

Embodiment 3

Figure 5A:
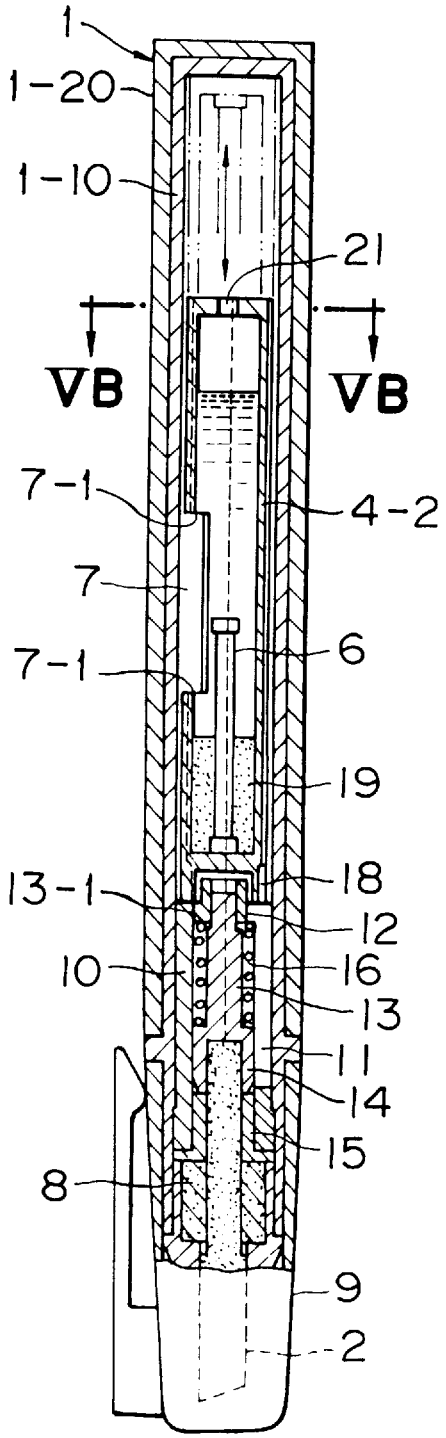
FIG. 5A is a vertical sectional view of a third embodiment of a single writing tip type writing tool of the present invention.
Figure 5B:
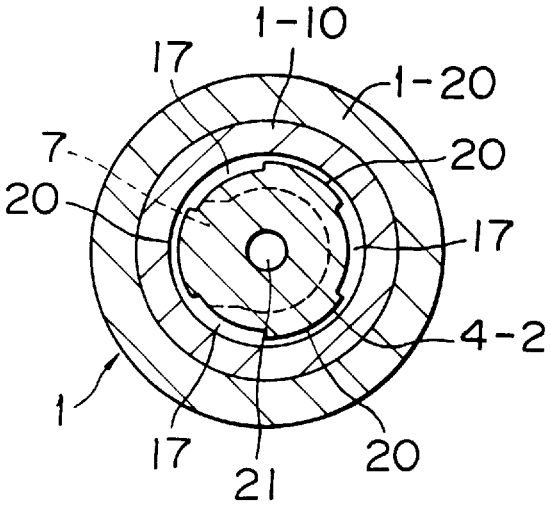
FIG. 5B is an enlarged sectional view taken along line VB—VB of FIG. 5A.

FIGS. 5A and 5B show a third embodiment of a single writing tip type writing tool having one writing tip 2 mounted only at one end of a cylindrical shell 1 through an ink flow-out control mechanism. In this writing tool, the cylindrical shell 1 is composed of an inner pipe 1-10 and an outer pipe 1-20, each of which is opened only on one end side; the writing tip 2 is mounted to one end opening portion of the inner pipe 1-10 through the ink flow-out control mechanism; and an ink containing cylindrical body 4-2 containing ink of a solid-liquid separation type and a stirring piece 6 is disposed in the inner pipe 1-10 so as to be movable in the longitudinal direction of the cylindrical shell 1. In addition, this embodiment has the same construction as that in each of the above-described embodiments, except for the inner pipe 1-10 and outer pipe 1-20 of the cylindrical shell 1 and the ink containing cylindrical body 4-2, and accordingly, parts corresponding to those in the above-described embodiments are indicated at the same characters, and the explanation thereof is omitted.

Each of the inner pipe 1-10 and the outer pipe 1-20 is formed to be opened only on one end. The enclosed ink containing cylindrical body 4-2 has a length enough to be movable in the longitudinal direction between the valve main body 10 fixedly provided in the one end opening portion of the inner pipe 1-10 and the enclosed end of the inner pipe 1-10. Like the above-described embodiments, an ink flow-out port 7 is formed on the wall of the ink containing cylindrical body 4-2, and ink flowing grooves 17 for communicating each opening end 7-1 of the ink flow-out port 7 to communicating grooves 18 provided on the outer periphery of one end portion of the ink containing cylindrical body 4-2 are formed on the outer periphery of the cylindrical body 4-2. Moreover, an ink flow hole 21 is provided at the axial center of the other end portion of the ink containing cylindrical body 4-2. With this ink flow hole 21, when the cylindrical shell 1 is strongly shaken, the ink 5 flowing out on the enclosed end portion of the inner pipe 1-10 in rapidly returned in the containing cylindrical body 4-2, and thereby the ink containing cylindrical body 4-2 is smoothly moved.

Like the above-described embodiments, in this embodiment, when the cylindrical shell 1 is strongly shaken, the ink containing cylindrical body 4-2 is moved in the longitudinal direction in the inner pipe 1-1 by the movement of the stirring piece 6. This makes it possible to accelerate the crushing action for a cake 19 by an impact force of the bar-like stirring piece 6, and hence to rapidly disperse a solid component in a liquid component in the ink containing cylindrical body 4-2 again. Namely, the crushing action for the cake 19 and the stirring action for the ink 5 are effectively performed by the longitudinal movement of the ink containing cylindrical body 4-2.

Embodiment 4

Figure 6A:
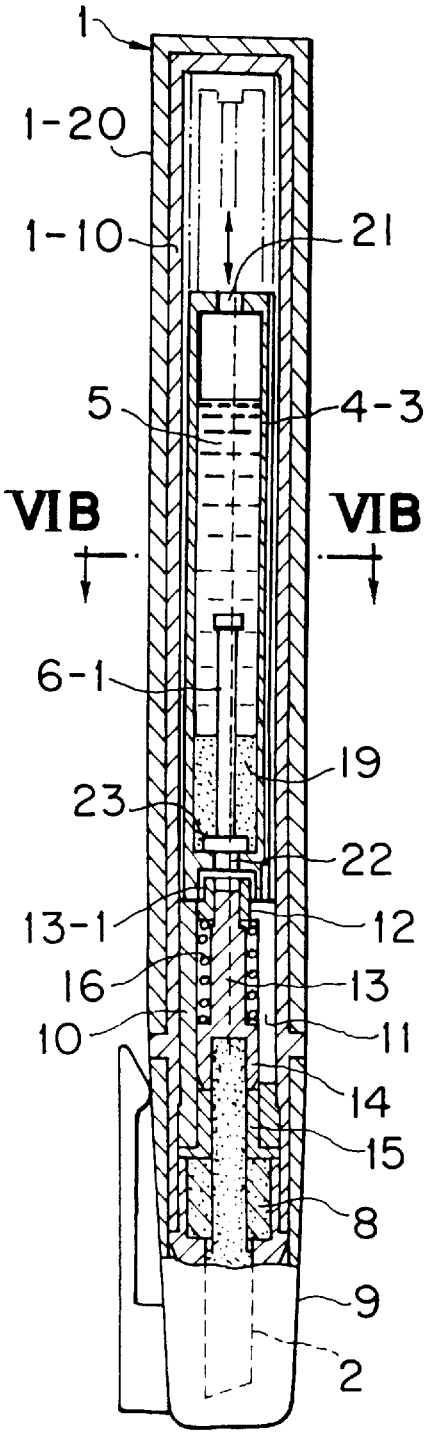
FIG. 6A is a vertical sectional view of a fourth embodiment of a single writing tip type writing tool of the present invention.
Figure 6B:
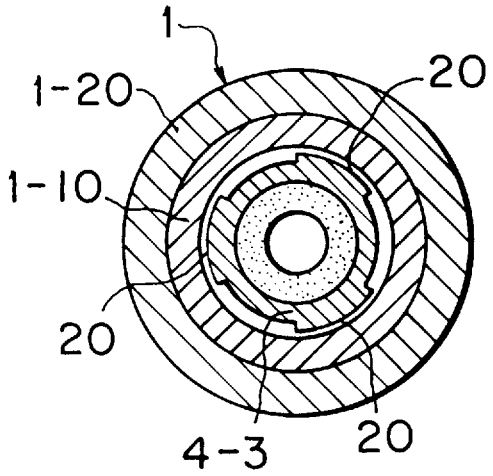
FIG. 6B is an enlarged sectional view taken along line VIB—VIB of FIG. 6A.

FIGS. 6A and 6B show a fourth embodiment of a single writing type writing tool, wherein an ink flow-out port 22 is formed at the axial center of the closed end portion of a containing cylindrical body 4-3 positioned on the ink flow-out control mechanism side, whereby ink 5 in the containing cylindrical body 4-3 is allowed to flow from the ink flow-out port 22 into a valve main body 10, to be thus supplied to a writing tip 2. Moreover, in the writing tool, a large diameter head portion 23 is provided on a bar-like stirring piece 6-1 for sealing the ink flow-out port 22 in the state that the writing tool is placed with the writing tip 2 directed downward, thereby preventing a solid component of the ink 5 from entering the valve main body 10 through the ink flow-out port 22. In addition, this embodiment has the same construction as those in the above-described embodiments, and accordingly, parts corresponding to those in the above-described embodiments are indicated at the same characters, and the explanation thereof is omitted.

Specifically, in this embodiment, the ink flow-out port 22 having a suitable opening diameter is formed at the axial center of the end portion of the ink containing cylindrical body 4-3 positioned on the valve main body 10 side for allowing the ink 5 in the ink containing cylindrical body 4-3 to flow in the valve main body 10 through the ink flow-out port 22, and the large head portion 23 having a diameter larger than the opening diameter of the ink flow-out port 22 is formed at one end portion of the stirring piece 6-1 for sealing the ink flow-out port 22 by the large diameter head portion 23 when the writing tool is placed with the writing tip 2 directed downward, thereby preventing the solid component of the ink 5 from entering the valve main body 10 through the ink flow-out port 22.

Embodiment 5

Figure 7:
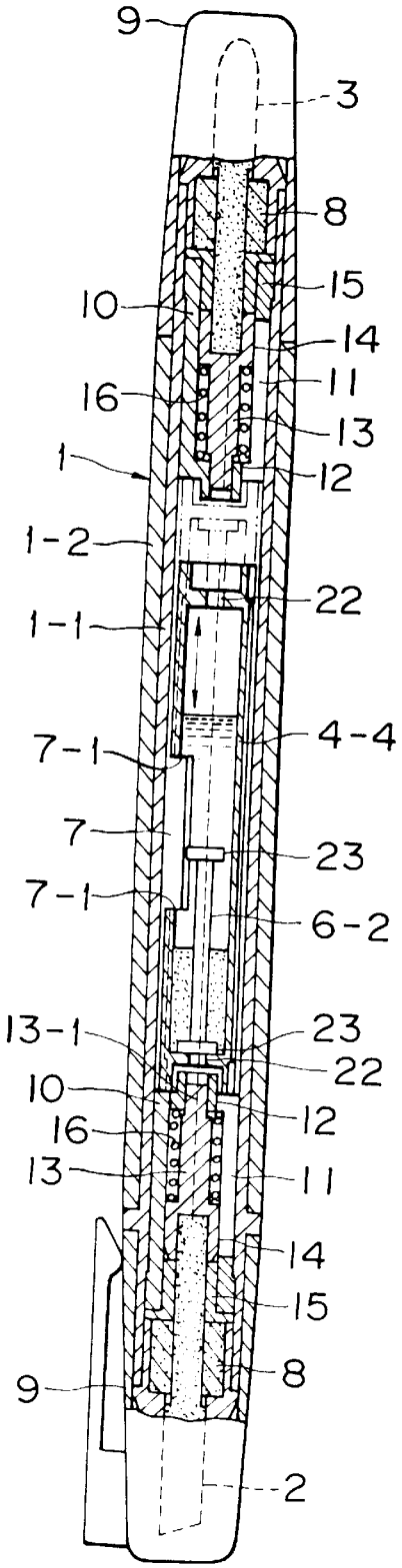
FIG. 7 is a vertical sectional view of a fifth embodiment of a double writing tip type writing tool of the present invention.

FIG. 7 shows a fifth embodiment of a double writing tip type writing tool having writing tips 2, 3 mounted to both the opening ends of an inner pipe 1-1 through ink flow-out control mechanisms. In this writing tool, ink flow-out ports 7 and 22 are respectively provided on the wall of an ink containing cylindrical body 4-4 disposed in the inner pipe 1-1 so as to be movable in the longitudinal direction therein and the enclosed end portions of the ink containing cylindrical body 4-4, whereby ink 5 in the ink containing cylindrical body 4-4 is allowed to flow into the valve main bodies 10 fixedly provided in the inner pipe 1-1 on both the end sides through the ink flow-out ports 7, 22.

Namely, this embodiment is obtained by combination of the double writing tip type writing tool according to the second embodiment shown in FIGS. 4A and 4B in which the ink containing cylindrical body 4-1 having the ink flow-out port 7 provided on the wall is disposed in the inner pipe 1-1 so as to be movable in the longitudinal direction therein and the single writing type writing tool according to the fourth embodiment shown in FIGS. 6A and 6B in which the ink containing cylindrical body 4-3 having the ink flow-out port 22 provided at the axial center of the enclosed end portion thereof is disposed in the inner pipe 1-10 so as to be movable in the longitudinal direction therein, so that the ink 5 in the ink containing cylindrical body 4-4 is supplied to the valve main body 10 through the ink flow-out ports 7, 22. Moreover, in this embodiment, large diameter head portions 23 are provided at both the ends of the bar-like stirring piece 6-2 for sealing the ink flow-out ports 22 at both the enclosed end portions of the ink containing cylindrical body 4-4 for preventing the solid component of the ink 5 from entering the valve main bodies 10.

Embodiment 6

FIGS. 8A to 8C and FIG. 9 show a sixth embodiment of a double writing tip type writing tool, wherein valve main bodies 10-1 of ink flow-out control mechanisms are improved to prevent a solid component of ink 5 from entering the valve main bodies 10-1 without provision of the above-described ink containing cylindrical body 4 separated from the ink flow-out control mechanisms. In addition, this embodiment has the same construction as that of each of the above-described embodiments except for the valve main bodies 10-1, and accordingly, parts corresponding to those in the above-described embodiments are indicated at the same characters, and the explanation thereof is omitted.

Figure 8A:
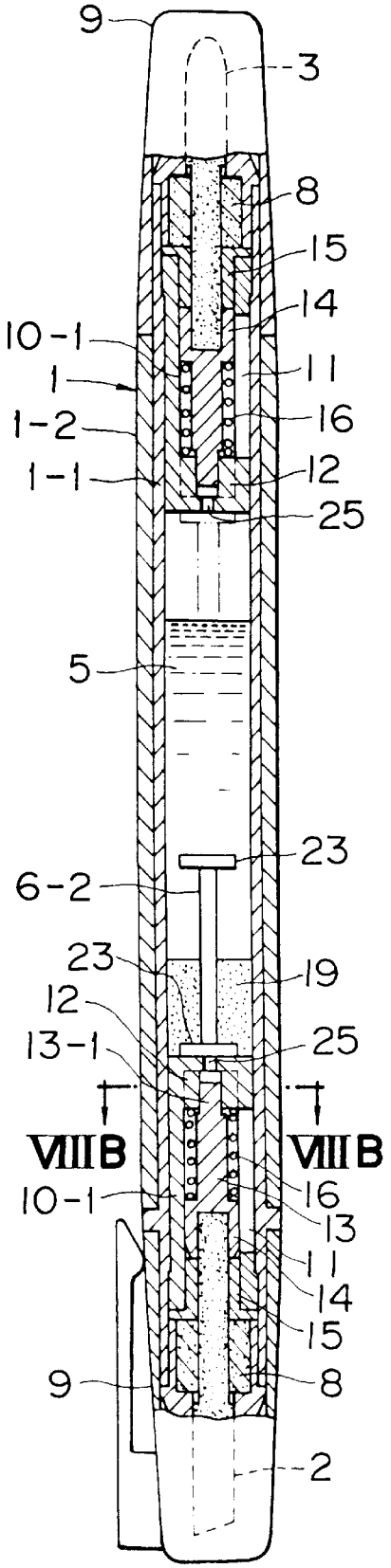
FIG. 8A is a vertical sectional view of a sixth embodiment of a double writing tip type writing tool of the present invention.
Figure 8B:
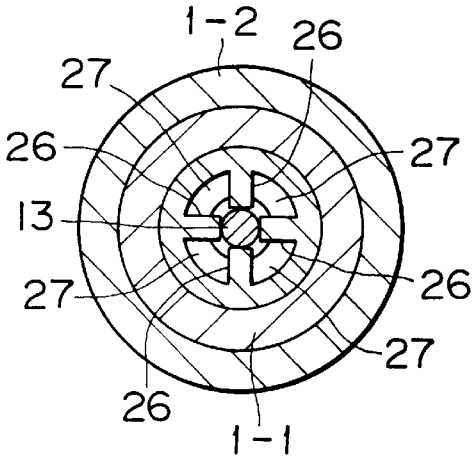
FIG. 8B is an enlarged sectional view taken along line VIIIB—VIIIB of FIG. 8A.
Figure 8C:
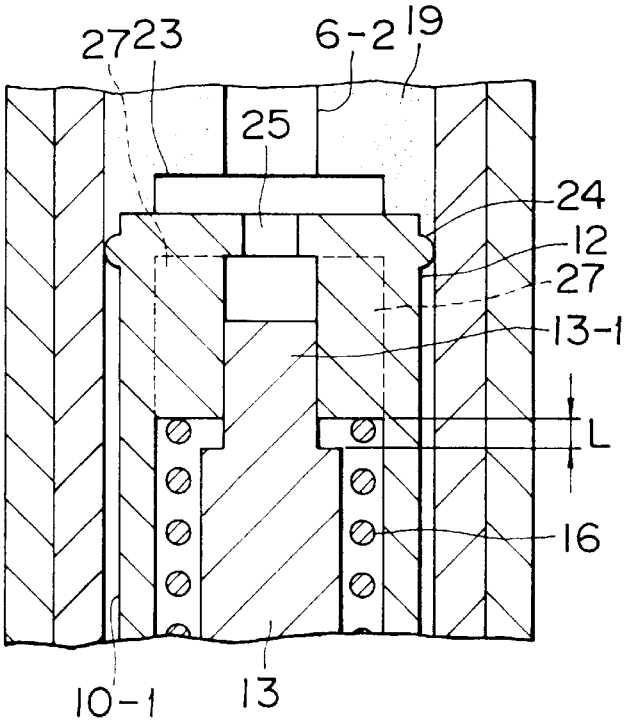
FIG. 8C is a an enlarged sectional view of an essential portion of FIG. 8A.

As shown in FIGS. 8A to 8C, in the double writing tip type writing tool having writing tips 2, 3 mounted to both the opening end portions of an inner pipe 1-1 through ink flow-out control mechanisms, an annular sealing projection 24 is formed around the outer periphery of the enclosed rear end portion of each valve main body 10-1 in such a manner as to be closely contacted with the inner periphery of the inner pipe 1-1; and an ink flow-out port 25 communicated to the valve main body 10-1 is formed at the axial center of the rear end portion of the valve main body 10-1. With this construction, the ink 5 directly contained in the inner pipe 1-1 is prevented from entering in the valve main body 10-1 by the annular sealing projection 24, and it is directly supplied into the valve main body 10-1 through the ink flow-out port 25. Moreover, in this embodiment, a large diameter head portion 23 having a diameter larger than the opening diameter of the ink flow-out port 25 of the valve main body 10-1 is provided on each end portion of a bar-like stirring piece 6-2 for sealing the ink flow-out port 25 of the valve main body 10-1 when the writing tool is placed with either of the writing tips 2, 3 directed downward, thereby preventing a solid component of the ink 5 from entering the valve main body 10-1.

In the valve main body 10-1, a valve supporting portion 12 for supporting the rear end of the valve 13 so as to be movable in the longitudinal direction is formed such that the outside diameter thereof is slightly smaller than the inside diameter of the inner pipe 1-1 (the valve main body 10-1 is formed in the cylindrical shape as a whole) and the annular sealing projection 24 closely contacted with the inner periphery of the inner pipe 1-1 is formed around the outer periphery of the valve supporting portion 12, so that the ink 5 is prevented from entering the valve main body 10-1 through the periphery of the valve supporting portion 12. The ink flow-out port 25 having a suitable opening diameter is formed at the axial center of the rear end of the valve supporting portion 12, and radially projecting pieces 26 are formed in the ink flow-out port 25 so as to extend in the longitudinal direction from the rear end surface of the ink flow-out port 25, so that gaps 27 communicating the ink flow-out port 25 to the valve main body 10-1 are formed between the projecting pieces 26 (see FIG. 8B) for supplying the ink 5 in the inner pipe 1-1 from the ink flow-out port 25 into the valve main body 10-1 through the gaps 27.

According to this embodiment, since the annular sealing projection 24 of the valve main body 10-1 is closely contacted with the inner periphery of the inner pipe 1-1, the ink 5 is contained in the inner pipe 1-1 while being separated from the valve main body 10-1. The ink 5 is supplied into the valve main body 10-1 from the ink flow-out port 25 opened/closed by the large diameter head portion 23 of the bar-like stirring piece 6-2 through the gaps 27 in the valve supporting portion 12, to be thus supplied to each of the writing pieces 2, 3. When the writing tool is placed with either of the writing tips 2, 3 directed downward, the ink flow-out port 25 of the valve main body 10-1 is sealed by the large diameter head portion 23 of the bar-like stirring piece 6-2. Accordingly, a solid component of the ink 5 is deposited and aggregated on the rear end portion side of the valve main body 10-1 having the ink flow-out port 25 sealed by the large diameter head portion 23 of the stirring piece 6-2, to form a cake 19. Namely, the solid component is prevented from entering the valve main body 10-1 from the ink flow-out port 25.

Embodiment 7

Figure 9:
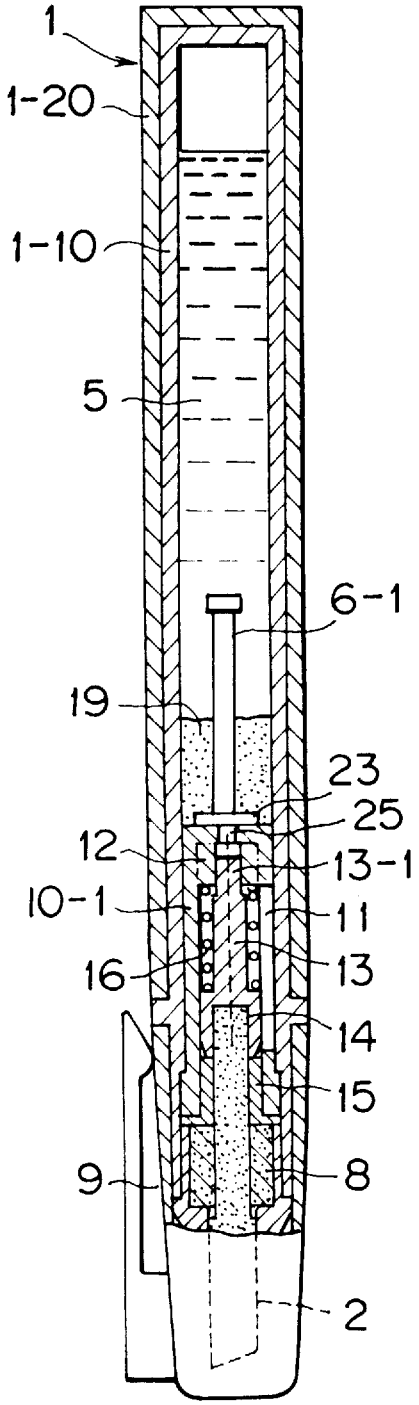
FIG. 9 is a vertical sectional view of a seventh embodiment of a single writing tip type writing tool of the present invention.

FIG. 9 shows a seventh embodiment of a single writing tip type writing tool having a writing tip 2 mounted to one end opening portion of an inner pipe opened only on one end side through an ink flow-out control mechanism, wherein an annular sealing projection 24 is provided around the outer periphery of a valve supporting portion 12 of a valve main body 10-1, like the sixth embodiment. With this construction, the ink 5 directly contained in the inner pipe 1-10 is separated from the valve main body 10-1. In the case where the writing tool is placed with the writing tip 2 directed downward, the ink flow-out port 25 of the valve main body 10-1 is sealed by a large diameter head portion 23 of the bar-like stirring piece 6-1, thereby preventing a solid component of the ink 5 from entering the valve main body 10-1 through the ink flow-out port 25. The solid component of the ink 5 is deposited and aggregated on the rear end side of the valve main body 10-1 having the ink flow-out port 25 sealed by the large diameter head portion 23 of the bar-like stirring piece 6-1, to form a cake 19. Thus, the ink 5 in the inner pipe 1-1 is directly supplied from the ink flow-out port 25 opened/closed by the large diameter head portion 23 of the stirring piece 6-1 into the valve main body 10-1 through gaps 27 of the valve supporting portion 12, to be thus supplied to the writing piece 2.

Embodiment 8

Figure 10A:
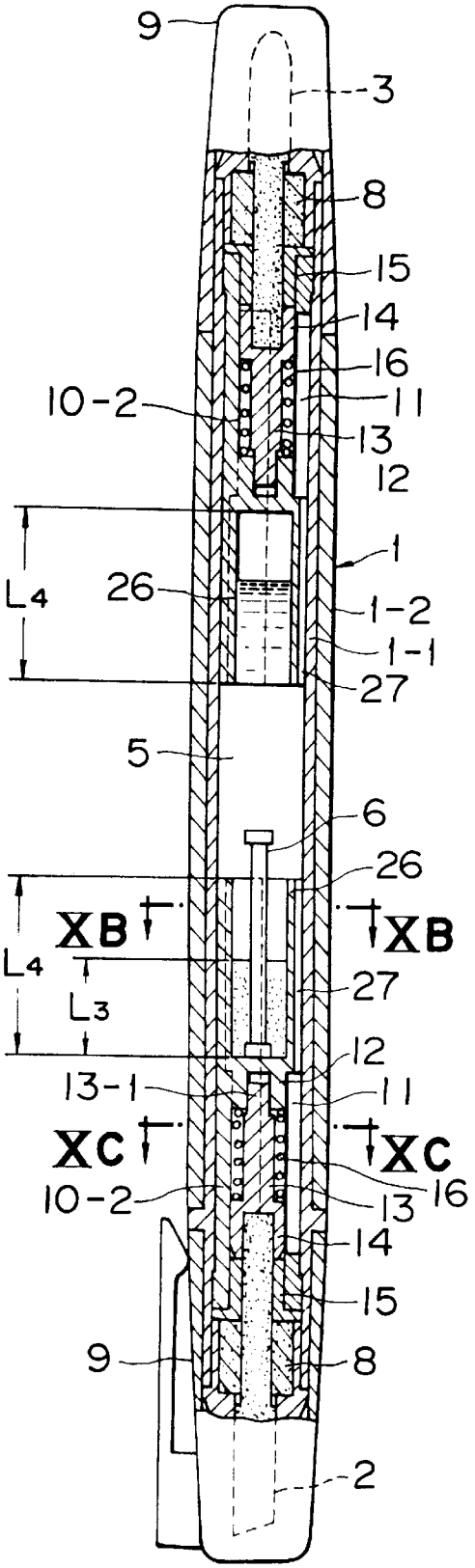
FIG. 10A is a vertical sectional view of an eighth embodiment of a double writing tip type writing tool of the present invention.
Figure 10B:
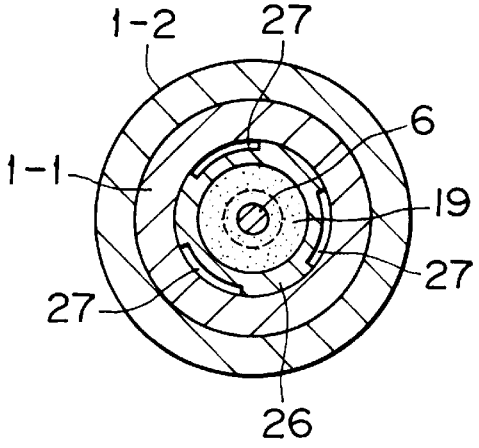
FIG. 10B is an enlarged sectional view taken along line XB—XB of FIG. 10A.
Figure 10C:
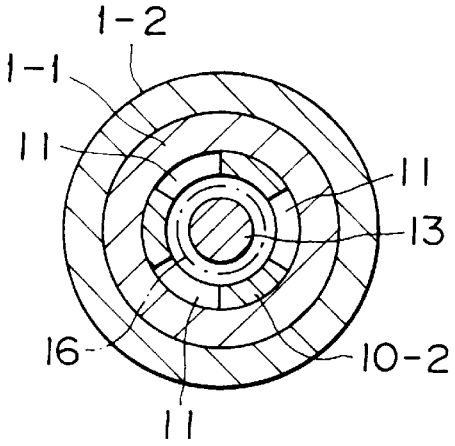
FIG. 10C is an enlarged sectional view taken along line XC—XC of FIG. 10A.

FIGS. 10A to 10C show an eighth embodiment of a double writing tip type writing tool, wherein valve main bodies 10-2 of ink flow-out control mechanisms are improved to prevent a solid component of ink 5 from entering the valve main bodies 10-2 without provision of the above-described ink containing cylindrical body 4 separated from the ink flow-out control mechanisms. In addition, this embodiment has the same construction as that of each of the above-described embodiments except for the valve main bodies 10-2, and accordingly, parts corresponding to those in the above-described embodiments are indicated at the same characters, and the explanation thereof is omitted.

As shown in FIGS. 10A to 10C, in this writing tool having writing tips 2, 3 mounted to both the opening portions of an inner pipe 1-1 through ink flow-out control mechanisms, each ink depositing portion 26 having a height L4 more than a height L3 of a cake 19 is formed coaxially in each valve main body 10-2 so as to extend in the longitudinal direction from the rear end of the valve main body 10-2, and ink flowing grooves 27 for communicating the opening end of the ink depositing portion 26 to ink introducing ports 11 of the valve main body 10-2 are formed around the outer periphery of the valve main body 10-2, whereby the ink 5 directly contained in the inner pipe 1-1 is supplied in the valve main body 10-2 through the ink flowing grooves 27, to be thus supplied to each of the writing tips 2, 3. When the writing tool is placed with either of the writing tips 2, 3 directed downward, a solid component of the ink 5 is deposited and aggregated in the ink depositing portion 26, to form the cake 19.

Since the ink depositing portion 26 has the length L4 more than the length L3 of the cake 19, the cake 19 is prevented from getting over the opening end of the ink depositing portion 26 and from entering the ink flowing grooves 27 communicated to the ink introducing ports 11 of the valve main body 10-2. Accordingly, the ink flowing grooves 27 are prevented from being clogged with the cake 19.

Embodiment 9

Figure 11:
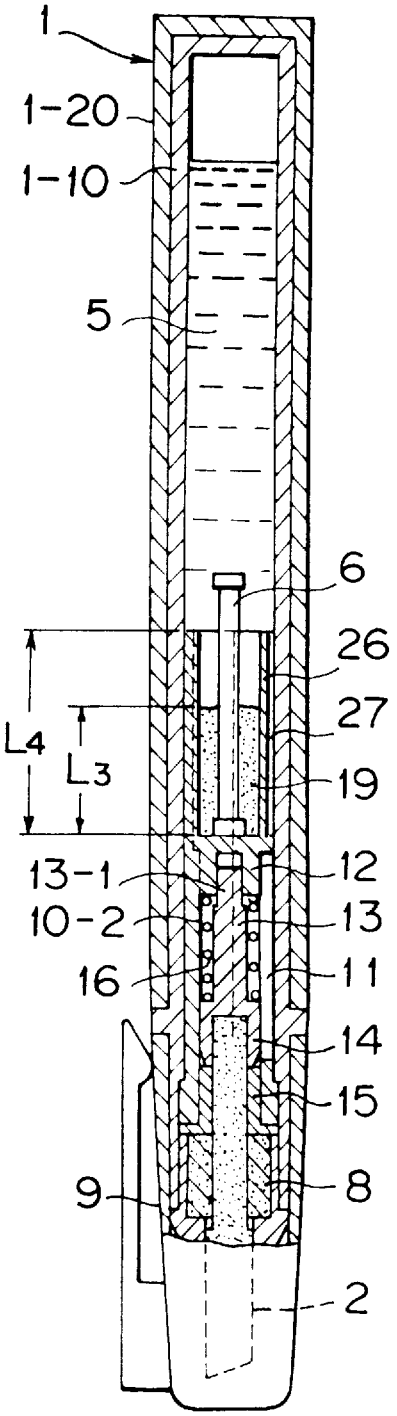
FIG. 11 is a vertical sectional view of a ninth embodiment of a single writing tip type writing tool of the present invention.
Figure 12:
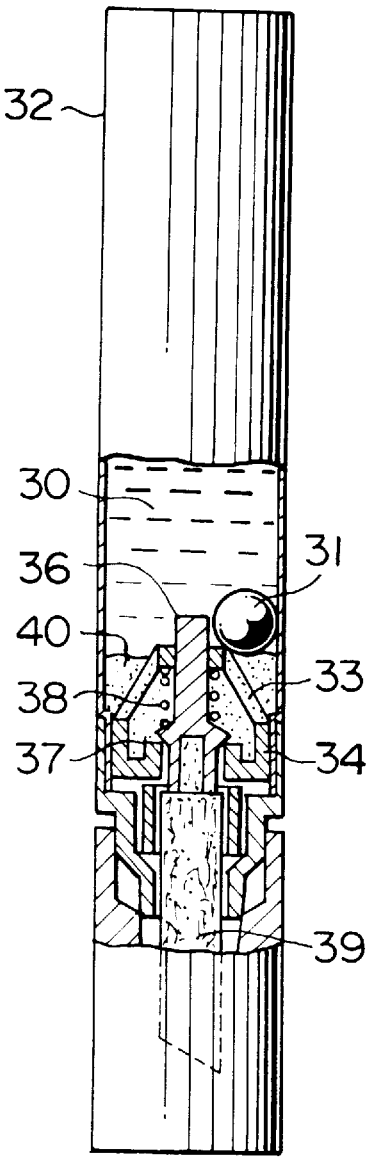
FIG. 12 PRIOR ART
FIG. 12 is a vertical sectional view of a prior art writing tool.

FIG. 11 shows a ninth embodiment of a single writing tip type writing tool having a writing tip 2 mounted to one end opening portion of an inner pipe 1-10 opened only on one end side through an ink flow-out control mechanisms, wherein the same ink depositing portion 26 as that described in the eighth embodiment is provided at the rear end of the valve main body 10-2. When the writing tool is placed with the writing tip 2 directed downward, a solid component of the ink 5 is deposited and aggregated in the ink depositing portion 26, to form a cake 19. The ink 5 in the inner-pipe 1-10 is supplied from the opening end of the depositing portion 26 in the valve main body 10-2 through ink flowing grooves 27 around the outer periphery of the valve main body 10-2, to be thus supplied into the writing tip 2.

Additionally, as shown in FIG. 8C, in the ink flow-out control mechanism in each of the above-described embodiments, the moving distance L of the valve 13 (the distance between a portion where the valve 13 is contacted with the valve seat 15 and a portion where it is separated therefrom) can be kept constant by contacting the base end of the insertion portion 13-1 of the valve 13 with the valve supporting portion 12 of the valve main body 10, 10-1 or 10-2. And, the length of the valve 13 is specified for keeping constant the moving distance L. Namely, the retreated amount of the valve 13 can be kept constant irrespective of the writing pressure or the like by specifying the above moving distance L, thereby usually supplying ink 5 in a specified amount to each of the writing tips 2, 3 of the valve main body 10, 10-1 or 10-2 in each of the above-described embodiments.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. A writing tool for use with a solid-liquid separation-type ink having at least one solid component, said tool comprising:

a first hollow cylindrical member generally extending in a longitudinal direction;

a second hollow cylindrical member disposed within said first hollow cylindrical member, said second member defining an inner cavity adapted to hold said ink;

an ink flow-out control mechanism disposed adjacent said second cylindrical member, said mechanism including:

a hollow valve main body having an inner surface, an outer surface, a valve supporting end portion and a peripheral sidewall, said sidewall being provided with an ink introducing port disposed therethrough;

a valve slidably contained within said valve main body, wherein said valve is capable of longitudinally advancing and retreating with respect to said valve main body; and a spring disposed within said valve main body for contacting said valve supporting end portion and said valve for outwardly biasing said valve;

a writing tip mounted to said ink flow-out control mechanism opposite said valve supporting end portion, said writing tip being capable of extending out of said first hollow cylindrical member;

ink delivery means for delivering said ink from said second hollow cylindrical member to said ink introducing port and for substantially confining any buildup of said solid component of said ink to said inner cavity of said second hollow cylindrical member, said ink delivery means including an ink flow-out port axially disposed through said valve supporting end portion of said valve main body for allowing said ink to flow therethrough from said inner cavity to said ink introducing port; and an elongated stirring piece axially movably disposed within said inner cavity, said elongated stirring piece having an enlarged head portion disposed at an end facing said ink flow-out port, said head portion being sized and shaped to cover said ink flow-out port when said elongated stirring piece abuts said ink delivery means, said head portion being wider than the diameter of said ink flow-out port;

wherein said elongated stirring piece seals said ink flow-out port when said writing tool is oriented such that said valve main body lies generally below said inner cavity;

whereby said enlarged head portion substantially prevents the solid component of the ink from entering said valve main body.

2. The writing tool according to claim 1 wherein said second hollow cylindrical member has at least one open end;

wherein at least part of said hollow valve main body is enveloped by said open end of said second hollow cylindrical member; and wherein said ink delivery means comprises a circumferential sealing projection disposed on said outer surface of said hollow valve main body for contacting the inner surface of said second hollow cylindrical member, thereby substantially preventing flow of said ink from said inner cavity, past said projection, and into said ink introducing port.

* * * * *